United States Patent [19]

Gurvis

[11] 4,236,148

[45] Nov. 25, 1980

[54] THEFT DETERRING AND SIGNALLING DEVICE FOR PORTABLE FIRE EXTINGUISHERS

[75] Inventor: Isadore Gurvis, Columbus, Ohio

[73] Assignee: Crown Auto Top Manufacturing Co., Columbus, Ohio

[21] Appl. No.: 21,687

[22] Filed: Mar. 19, 1979

[51] Int. Cl.[3] ..... G08B 21/00; G08B 13/14

[52] U.S. Cl. ..... 340/568; 116/99; 340/572

[58] Field of Search ..... 340/568, 570, 571, 572, 340/384 E, 384 R, 404; 116/99; 169/23

[56] References Cited

U.S. PATENT DOCUMENTS

| | | | |
|---|---|---|---|
| 2,754,498 | 7/1956 | Lavelle | 340/568 |
| 3,815,117 | 6/1974 | Gopperton | 340/571 |
| 4,003,048 | 1/1977 | Weise | 340/568 |
| 4,125,084 | 11/1978 | Salmonsen et al. | 116/99 |

*Primary Examiner*—Thomas A. Robinson
*Attorney, Agent, or Firm*—Robert E. Stebens

[57] ABSTRACT

An anti-theft alarm device for fire extinguishers is provided for use in conjunction with a standard-type, portable fire extinguisher. The structure of the alarm device includes a protective, anti-tamper housing with a sound producing device utilizing a bell crank, an actuating spring, and a hold down arm. Disengagement of the bell crank from the hold down arm occurs when the fire extinguisher is removed from its supporting bracket actuates the alarm. The device provides an alarm when an unauthorized taking of a fire extinguisher occurs and helps to locate the stolen extinguisher. Additionally, it serves as a fire alarm in case of a real fire and the fire extinguisher is being properly utilized.

10 Claims, 5 Drawing Figures

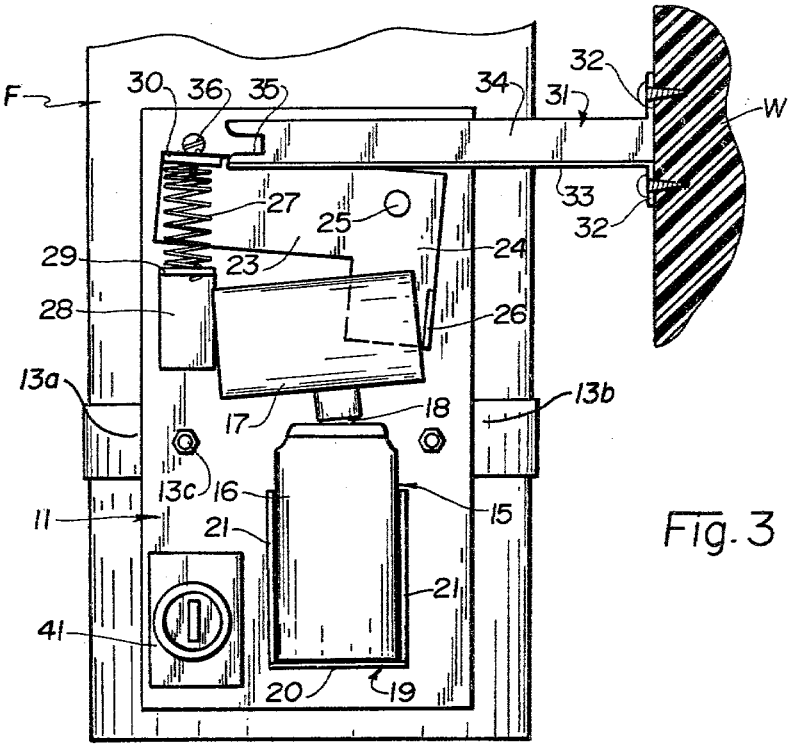
Fig. 3
Fig. 4
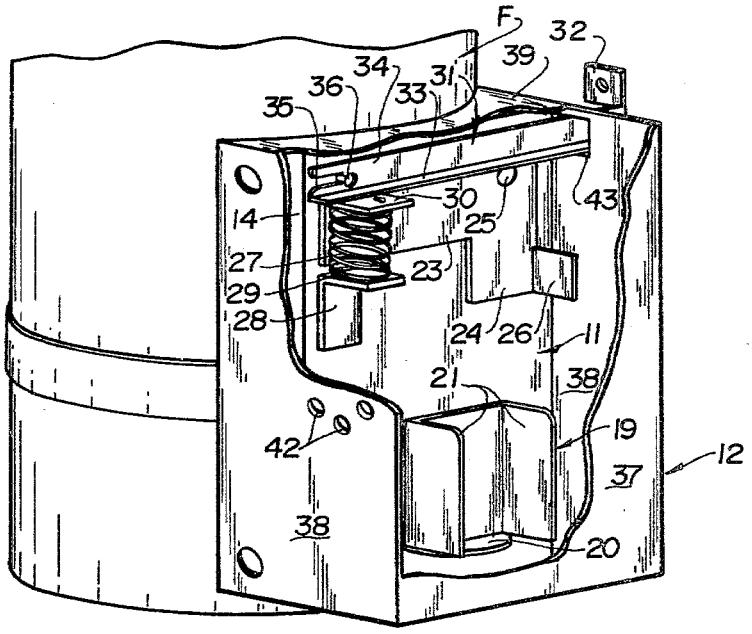

THEFT DETERRING AND SIGNALLING DEVICE FOR PORTABLE FIRE EXTINGUISHERS

BACKGROUND OF THE INVENTION

This invention is directed to the providing of an alarm or signalling device which is designed to be utilized in combination with a portable fire extinguisher. Numerous fire code provisions necessitate the placement of relatively small sized, hand carried and highly portable fire extinguishers in places so as to be immediately available in case of fire. Therefore, the extinguishers cannot be stored in a secured or locked area or cabinet. They must be maintained in a physical location such that they are available and ready for use. This presents a problem in that thefts of fire extinguishers occur because the extinguishers are often located in remote or normally unobserved locations. The dangerous consequences of these thefts are most fully recognized when an emergency arises which requires a fire extinguisher, but none can quickly be found due to the theft of the extinguisher.

Previous attempts have addressed themselves to this problem in providing for an anti-theft alarm system for such readily portable fire extinguishers. There have been basically two approaches to the problem. One approach has been to incorporate an alarm system into the cabinet containing the fire extinguisher in such a manner that the opening of the cabinet activates the alarm mechanism. The second approach has been to incorporate the alarm system into the support device for the fire extinguisher in such a manner that the removal of the extinguisher from its support activates the alarm. U.S. Pat. Nos. 4,034,697 and 4,015,250 are examples of the first described approach, while U.S. Pat. No. 3,893,095 is an example of the second approach. Both approaches have their drawbacks. With the first approach, it is possible to remove the fire extinguisher from its cabinet by cutting the glass cover so as not to actuate the alarm. With the second approach, it is possible to circumvent the actuation of the alarm by the insertion of an appropriate object to restrain the alarm mechanism. Also, with either approach, once the extinguisher is removed (stolen) recovery of the extinguisher is difficult, if not impossible.

SUMMARY OF THE INVENTION

In accordance with this invention, an anti-theft or theft deterring alarm device for fire extinguishers is provided for use in combination with a fire extinguisher. While the invention is designated as anti-theft, it will be understood that this terminology is deemed appropriate since the theft-deterring aspect will have the beneficial result of discouraging anyone from attempting to steal a fire extinguisher equipped with a device embodying this invention. The housing structure of the base unit for this device is formed from sheet metal having the alarm components of the device attached to or carried by the base unit and retained in locked relationship with a fire extinguisher. An outer cover, which is also formed from sheet metal, provides physical protection for the alarm components which are designed to produce a loud and distinctive sound. The entire alarm device is physically attached to the fire extinguisher by mechanical means of a metal band which is designed to prevent disassembly from the fire extinguisher unless the housing structure is first disassembled.

Included in the novel structural combination are a wall bracket and a hold down arm which serve to support the fire extinguisher on a wall, a bell crank which when displaced by an actuating spring serves to activate a noise producing device, and the metal base unit, outer cover and attachment band. The noise producing device is preferably comprised of a compressed-air, horn-type element, but alternatively could utilize an electrically driven sound producing device, such as those using piezoelectric crystals. The outer cover is attached to the base unit by means of a key operated locking device which allows only authorized individuals to de-activate the alarm mechanism, such as when routine service or examination of the extinguisher is required.

This anti-theft alarm for fire extinguishers is activated by the simple physical operation of removal of the fire extinguisher from its normally supported position with respect to the hold down arm. The actuating spring then displaces the bell crank which in turn activates the noise producing device thereby sounding the alarm and the locked housing prevents tampering or any attempts to either deactivate the alarm or prevent its normal functioning.

The primary objective of this invention is to provide a warning sound whenever the fire extinguisher is removed from its bracket as it may be supported on a wall or post structure. Two equally important aspects of this objective are to serve as a theft deterrent and as a fire alarm.

A further objective of this invention is to serve as an anti-theft device for fire extinguishers, by activation of an alarm whenever the fire extinguisher is removed. An additional aspect of this objective is that, in addition to sounding an alarm when the extinguisher is removed, the fact that the device remains directly attached to the extinguisher aids in locating the extinguisher in the event of theft, or equally advantageously, warn other persons of the proper use of a fire extinguisher and locate the area of use.

Another objective of this invention is to serve as an anti-theft device for fire extinguishers by being designed in such a way as to prevent unauthorized persons from tampering with the device in an attempt to circumvent the alarm mechanism.

Still a further objective is to alert other persons that an emergency may exist in the case of a real fire, thereby aiding in combatting the fire and possibly saving lives and property.

These and other objects and advantages of this invention will be readily apparent from the following detailed description of an illustrative embodiment thereof. Reference will be had to the accompanying drawings which illustrate embodiments of the invention.

DESCRIPTION OF THE DRAWING FIGURES

FIG. 3 is a front elevational view of the anti-theft device base unit showing the effect of removal of the fire extinguisher from its place of support.

FIG. 4 is a perspective view of the anti-theft device but with the signalling device removed therefrom and the cover partially broken away to better illustrate the components.

DESCRIPTION OF THE ILLUSTRATIVE EMBODIMENTS

Figure 1:
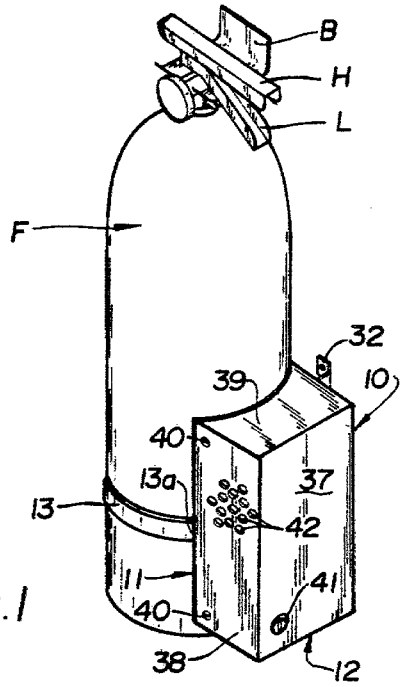
FIG. 1 is a perspective view of a fire extinguisher equipped with an anti-theft device embodying this invention.

Having reference to the drawings, specifically FIG. 1, a portable fire extinguisher designated generally by the letter F is shown mounted on a wall W by a supporting bracket B. This supporting bracket B has a pair of outwardly projecting arms which interengage with the operating head assembly of the extinguisher that includes a carrying handle H provided with an actuating lever L. Removal of the extinguisher F from the bracket B is accomplished by merely pulling forward on the extinguisher thereby causing the operating head assembly and its carrying handle H to be slid off of the bracket.

In accordance with this invention, the fire extinguisher is provided with an anti-theft device designated generally by the numeral 10. This anti-theft device comprises a structural housing having a base plate 11 with a cover 12 removably secured thereto and a mounting band 13. The mounting band 13 is designed to encircle the cylindrical body of the fire extinguisher F in secured clamping relationship with terminal ends of the band being attached to the base plate 11 by appropriate fastening mechanisms enabling the device to be removably clamped to a fire extinguisher. These terminal ends 13*a* and 13*b* are generally concealed under the base plate 11 with only the screw-type fastening mechanisms 13*c* being visible in FIGS. 2, 3 and 5 when the cover 12 is removed. Preferably, the base plate 11 is formed with a depending skirt 14 having terminal edges thereof configured to closely interfit with the outer cylindrical surface of the extinguisher to conceal and protect the band attachment and enhance the stability of the base plate. Vertical location of the device 10 on a fire extinguisher F may be at any selected location but is preferably at the lower end to avoid interference with the operating mechanism and handle H.

Figure 2:
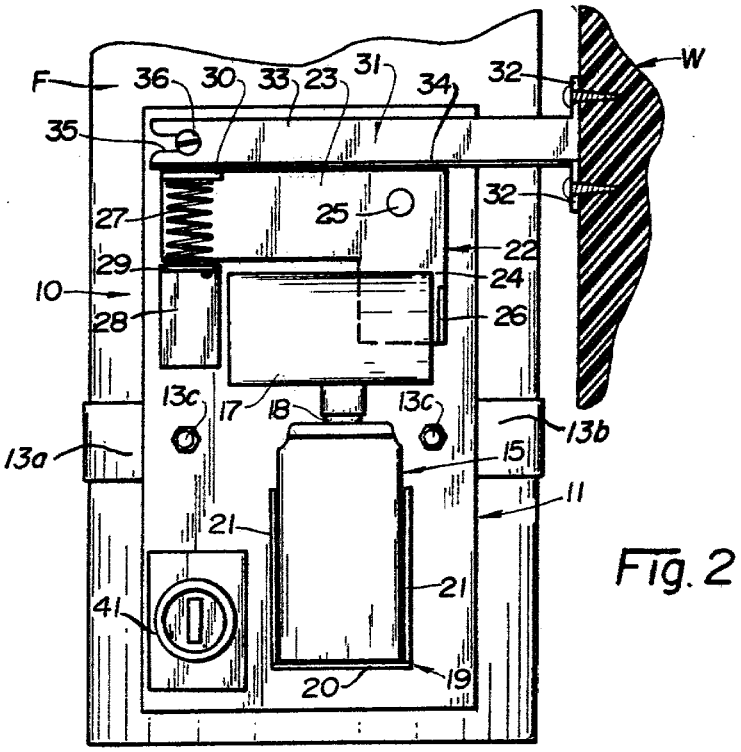
FIG. 2 is a front elevational view of the anti-theft device having a compressed-gas powered signalling device.

FIGS. 2, 3 and 4 disclose the internal operating components of the anti-theft device 10 which is shown in those figures with the cover 12 removed. These components are designed to effect operation of a sound producing device 15 which in this illustrative embodiment is a self-contained unit that is powered by compressed gas. Such devices are well known and commercially available for the purpose of providing a loud audible alerting signal and are intended to be carried by people as a personal protection device. A typical commercially available device 15 includes a compressed gas cylinder 16, a horn 17 and a valve stem connector 18. Incorporated in the valve stem connector 18 is a valve mechanism which is of a well-known type that is operated through lateral displacement of the valve stem which results in movement of a valve element to an open position to permit escape of the compressed gas. This escaping gas is routed through the valve stem connector 18 and into the horn 17 of elongated cylindrical configuration that is carried on the upper or free end of the connector which is designed to permit limited flexing movement with respect to a vertical axis. As the gas travels through the horn, it functions to generate a loud and uniquely identifiable sound. Specific constructional features of the device 15 are well known and it will suffice for purposes of disclosing this invention to note that the cylinder 16 is removably mountable on the base plate 11 in a generally vertical orientation by a channel-shaped bracket 19 with the horn 17 thus extending horizontally across the base plate. The bracket 19 includes a bottom plate 20 providing vertical support for the cylinder and a pair of side walls 21 that are designed to resiliently engage the cylinder.

Operation and control over actuation of the sound producing device 15 is provided by a spring-powered lever mechanism which includes, as its primary component, a bell crank 22. This bell crank 22 includes the two legs 23 and 24 which respectively extend in generally horizontal and vertical directions. The crank 22 is formed from a rigid metal plate and is adapted to be disposed in coplanar relationship to the surface of the base plate 11 and is secured thereto by a pivot pin 25. This mounting thus permits the crank to oscillate about a horizontal axis in a vertical plane. Referring to FIG. 2, it will be seen that the pivot pin 25 is positioned to support the crank 22 vertically above the sound producing device with the vertical leg 24 projecting a distance downwardly into operative relationship to the horn 17. This vertical leg has a terminal end portion generally coextensive with the one end of the horn 17 which can be considered as an operating end that is closed while the opposite end of the horn is open for emission of the sound produced by the excaping gas. Integrally formed with the lower terminal end portion of the vertical leg 24 is a horn actuating plate 26 that projects a distance outwardly to extend into coextensive relationship to the axial end of the horn. Thus, it will be seen that oscillation of the crank 22 in a clockwise direction about its pivot pin 25 will result in swinging of the actuating plate 26 into engagement with axial end of the horn 17. This functional operation is illustrated in FIG. 3 with the crank having been pivoted to an extent that the horn 17 is displaced along with the valve stem connector 18 to result in operation of the sound producing device 15.

Operation of the bell crank 22 to effect the necessary rotational movement thereof about the pivot pin 25 is effected by a helical compression spring 27. This spring is supported on an L-shaped bracket 28 that is rigidly secured to the base plate 11 in underlying relationship to the outer terminal end of the horizontal leg 23 of the bell crank. The bottom end of the spring 27 rests against an outwardly projecting leg 29 of the bracket 28 with the upper end projecting into operative engagement with the crank's horizontal leg 23. Interengagement is facilitated by a contact plate 30 which is integrally formed with the crank leg and projects a distance laterally thereby providing a surface for engagement with the spring 27. Preferably, each end of the spring 27 is mechanically secured to the bracket leg 29 and contact plate 30 as by looping an end coil section through an aperture formed in the respective component to assure maintenance of the components assembled relationship.

Controlling operation of the bell crank 22 and normally opposing the spring 27 is an elongated restraining arm 31. The restraining arm 31 has a mounting base including a pair of screw attachment plates 32 which enable securing of the arm to the wall W. Mounting of the arm is at a vertical elevation such that it projects horizontally along the upper end of the base plate 11 and immediately above the uppermost edge of the crank's horizontal leg 23. It is also located laterally relative to the fire extinguisher F so that it is closely adjacent to but does not contact the base plate 11 or interfere with movement of the fire extinguisher and associated components of the anti-theft device. To achieve the required structural rigidity, the arm 31 is advantageously formed with an L-shaped cross section having the one flange 33 horizontally disposed and the other flange 34 in closely adjacent parallel relationship to the base plate 11. When the fire extinguisher F is positioned on its supporting bracket B in vertically depending relationship, the restraining arm's horizontal flange 33 projects over the contact plate 30 of the crank and will thus hold the crank 22 against clockwise pivoting movement as a result of the compressed force of the spring 27.

For greater stability and effective elimination of a constantly applied pivoting force, the terminal end of the arm has an elongated slot 35 which opens axially outward of the elongated arm and is adapted to cooperatively receive a retainer pin 36 which rigidly is affixed to the base plate 11. Mechanical interengagement of the slot 35 with the pin 36 which projects laterally from the base plate results in the pin providing resistance to the spring's biasing force and thus effectively eliminates the application of a continuously applied bending force to the arm.

Completing the structural housing of the anti-theft device is the cover 12. This cover formed as a rigid box-shaped structure which is positioned on and secured to the base plate 11, and of a size to receive the internal components and permit their operation. Included in the cover is a face panel 37 and a peripheral wall having four side panels 38 and 39 configured to fit around the base plate. The cover side panels 38 are mechanically secured to the base plate skirt 14 by metal screws 40 to provide structural integrity. However, it is preferred that a locking device also be provided to prevent removal of the cover by unauthorized persons and disabling or removal of the sound producing device 15. Such a locking device is shown in the drawings as comprising a key operated unit 41 having a base section that is secured to the base plate 11 and latching section (not shown) secured to the interior of the cover's face panel 37. The cylindrical end of the unit's base section projects into an aperture formed in the cover thus providing exterior access to the lock for insertion of a key. One of the cover side panels 38 is provided with a number of apertures 42 that are located in general alignment with the end of the horn 17 for enhancement of sound transmission. The other side panel 38 is provided with an aperture 43 at its upper end through which the restraining arm 31 projects and thus permits insertion or withdrawal of the arm therethrough.

Functional operation of the anti-theft device 10 can be best understood by reference to FIG. 3 which has the cover 12 removed so that operation of the components can be seen. In this Figure, the fire extinguisher F is shown as being laterally displaced from the wall W such that the end of the restraining arm 31 will have disengaged from the pin 36 as well as being withdrawn from overlying relationship to the contact plate 30. This is representative of the initial operating sequence of the several components as would result if the fire extinguisher were removed from its supporting bracket, it being understood that the restraining arm would then be in the process of being withdrawn through the aperture 43 in the rear side panel 38 of the cover 12. At this point, the restraining arm 31 is no longer functional in counteracting the biasing force of the spring 27 which then becomes operative to pivot the bell crank 22 in a clockwise direction. As the bell crank pivots, the crank's vertical leg 24 will swing the actuating plate 26 into contacting engagement with end of the horn 17 and displace the horn in the illustrated manner. As previously explained, displacement of the horn in this manner will also operate the valve stem connector 18 to open the valve and release the compressed gas from the cylinder 16 thereby resulting in generation of sound by the horn. Because of the spring 27, the bell crank 22 will remain biased to its attained position as shown in FIG. 3 thus continuing generation of the sound until the supply of compressed gas is sufficiently depleted that the horn will cease to function. While the compressed gas supply is limited, sound producing devices 15 of this type are normally capable of operation for a period of a few minutes which will be adequate to induce a thief to drop the fire extinguisher and quickly depart the area. Since the cover 12 prevents any attempt to otherwise silence the sound producing device, any would-be thief must either continue carrying a fire extinguisher which is making noise and clearly identifying the theft to others or drop the extinguisher, the latter being the most likely and thus prevent the theft.

Servicing of the anti-theft device 10 to either check the serviceability of the sound producing device 15, or to replace such device, after an attempted theft, is readily accomplished by first removing the cover 12 from the base plate 11. This is a accomplished by using a proper key with lock unit 41 and removing the metal screws 40. With the cover removed and the sound producing device 15 not installed in its channel shaped bracket 19, the fire extinguisher F can be readily remounted on its supporting bracket B and the restraining arm 31 directed into assembled relationship as shown in FIGS. 2 and 4. This reassembly is easily accomplished by manually compressing the spring 27 through counterclockwise pivoting of the bell crank 22 until the arm 31 may be slid over the contact plate 30 and the retainer pin 36 caused to slide into the slot 35. When thus assembled, a sound producing device 15 may then be positioned in the bracket 19. Reassembly of the cover 12 can then be accomplished by aligning the aperture 43 in the cover side panel 38 with the restraining arm 31 and positioning cover on the base plate 11 where it is again secured by the lock unit 41 and the screws 40.

Figure 5:
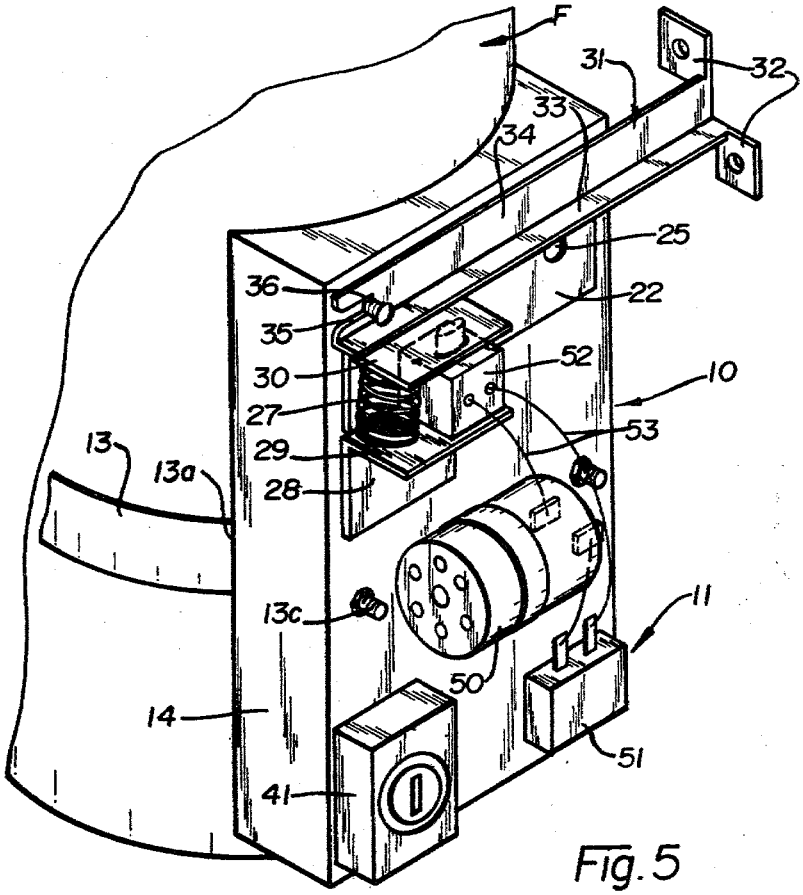
FIG. 5 is a perspective view of a modification of the anti-theft device in which an electrically driven sound producing device is utilized.

A modification of the anti-theft device 10 is shown in FIG. 5 with components that are the same as in the first described embodiment being identified by the same numbers. This modified device is designed to utilize an electrical sound producing device 50, a battery-type power source 51 and control switch 52 being also provided. The device 50 may be any selected type of device which is operable on low voltage electrical power that can be conveniently provided by a battery. A piezoelectric device is a particularly suitable type of device. These components are secured to either the base plate 11 or, as illustrated, the control switch 52 may be mounted on the outwardly projecting lug 29 of the bracket 28. Electrical conducting wires 53 interconnect the components in series circuit relationship with the switch 52 having a set of normally open contacts. In this embodiment, the bell crank 22 is modified to comprise only a lever that is pivoted on a pivot pin 25. Operation is substantially the same as that previously described with the control switch 52 having its contacts maintained in an open circuit condition when the unit is assembled as shown in FIG. 5 and thus preventing operation of the sound producing device 50. When the fire extinguisher F is removed from its supporting bracket, the crank lever 22 will be released for pivoting movement and permit the control switch to function in closing its contacts to complete an electrical circuit and energize the sound producing device 50.

It will be readily apparent, from the foregoing description of illustrative embodiments of this invention, that a particularly novel and extremely useful anti-theft alarm device is provided for portable fire extinguishers. The alarm device can be easily attached to existing fire extinguishers. The structural metal housing serves to protect the components of the alarm device and prevent disabling interference therewith. The alarm device itself could be used out of doors as well since the mechanism would not be affected by the weather.

Having thus described this invention, what is claimed is:

1. An anti-theft alarm device for a portable fire extinguisher removably mounted on a supporting structure in predetermined relationship thereto comprising a structural housing having attaching means adapted for securing of the housing to a fire extinguisher in fixed relationship, said housing defining an interior compartment and including removable cover means providing access to the compartment, said cover means securable in closing relationship by a locking device, a sound producing device carried by said structural housing in the interior compartment thereof, actuating means carried by said structural housing in the interior compartment thereof and operatively interconnected with said sound producing device to effect operation thereof, and control means adapted to be mechanically in retained relationship on the supporting structure for the fire extinguisher and selectively interengageable with said actuating means and preventing operation thereof when the fire extinguisher is mounted on the supporting structure in the predetermined relationship and enabling operation of said actuating means when the fire extinguisher is displaced a predetermined distance from its described supported position.

2. An anti-theft alarm device according to claim 1 wherein said structural housing has an aperture formed in a wall thereof providing access to the interior compartment, said control means includes an elongated restraining arm having mounting means formed at one end thereof for mounting on the fire extinguisher supporting structure and projectable into the interior compartment of said structure housing through said aperture, the portion of said arm projectable into the interior compartment selectively interengageable with said actuating means in mechanically coupled relationship to prevent operation thereof.

3. An anti-theft alarm device according to claim 2 wherein said actuating means includes a lever mechanism pivotably mounted on the housing for swinging movement between a first position where said sound producing device is not operated and a second position where said sound producing device is operated, and resilient biasing means mechanically coupled with said lever mechanism and urging said lever mechanism to said second position, said restraining arm mechanically interengageable with said lever mechanism for maintaining said lever mechanism in said first position against the force of said biasing means.

4. An anti-theft alarm device according to claim 3 wherein said lever mechanism includes a first lever arm and said biasing means is mechanically coupled therewith, said restraining arm engageable with said first lever arm.

5. An anti-theft alarm device according to claim 3 wherein said lever mechanism includes a lever arm mechanically interengageable with said sound producing device and operable to effect operation thereof when said lever mechanism is pivoted from said first position to said second position.

6. An anti-theft device according to claim 5 wherein said sound producing device includes a compressed gas container, a horn operable to generate sound in response to passage of gas therethrough and valve means interconnecting the compressed gas container with the horn and selectively operable to permit discharge of gas through the horn, and said lever arm is operatively coupled with the valve means to effect operation thereof to permit discharge of gas when said lever arm is pivoted to said second position.

7. An anti-theft alarm device according to claim 5 wherein said sound producing device includes an electrically powered sound generating unit, an electrical battery power source and an electrical switch interconnected in circuit with the sound generating unit and the battery power source for controlling energization of the sound generating unit, said lever arm operatively coupled with said electrical switch to effect operation thereof in completing an electrical circuit between the battery and sound generating unit when said lever arm is pivoted to said second position.

8. An anti-theft alarm device according to claim 3 wherein said lever mechanism includes a first lever arm of predetermined length and having a contact plate formed therewith in relatively remote relationship to the pivot mounting, said resilient biasing means and restraining arm mechanically interengageable with said contact plate.

9. An anti-theft alarm device according to claim 8 wherein said resilient biasing means is a helical compression spring disposed with an axial end thereof bearing against said contact plate.

10. An anti-theft alarm device according to claim 8 wherein said structural housing includes a retainer pin mounted thereon in fixed relationship in the interior compartment, and said restraining arm is mechanically interengageable therewith when disposed in mechanically interengaged relationship with said contact plate.

* * * * *